United States Patent [19]

Puryear

[11] 4,030,473

[45] June 21, 1977

[54] CROSSBOW TRIGGER

[75] Inventor: John W. Puryear, Tulsa, Okla.

[73] Assignee: Brunswick Corporation, Skokie, Ill.

[22] Filed: June 25, 1975

[21] Appl. No.: 590,378

[52] U.S. Cl. ..... 124/35 R; 124/40; 124/25

[51] Int. Cl.[2] ..... F41C 19/00

[58] Field of Search ..... 124/35 A, 24 R, 41 A, 124/25, 35 R

[56] References Cited

UNITED STATES PATENTS

| | | | |
|---|---|---|---|
| 1,133,189 | 3/1915 | Shannon | 124/25 |
| 1,192,639 | 7/1916 | Hunholz | 124/25 |
| 2,842,114 | 7/1958 | Duncan | 124/35 A |
| 3,739,765 | 6/1973 | Moore | 124/25 |

*Primary Examiner*—Richard C. Pinkham
*Assistant Examiner*—William R. Browne
*Attorney, Agent, or Firm*—David S. Guttman; John G. Heimovics; W. G. Lawler, Jr.

[57] ABSTRACT

A crossbow trigger whose features include only a unitary leaf spring, without the help of coiled springs, whose four end portions clamp a crossbow bolt on a crossbow stock, bias the crossbow's sight, bias the crossbow's finger lever, and prevent accidental disengagement of the crossbow's trigger safety. A stop plate is provided on the crossbow trigger's sear to automatically provide a proper space between the rear end of a crossbow bolt and the portion of the bowstring held by the cocked trigger.

10 Claims, 12 Drawing Figures

10
11
58
12
14
17

18
20
15
16a
16
56
24
26
22
26
56
36
45
44
41
46
50
48
34
32
32
38
54
35
43
33a
42
35
33b
28
64
62
60
30
65
68
66
58
100
86
102
84
99
110
104
98
92
90
112
76
80
74
96
78
100
111
106
94
82
80
108
72
69
70
83
109

CROSSBOW TRIGGER

BACKGROUND OF THE INVENTION

1. Field of the Invention

The present invention relates to a trigger for crossbows, and more particularly to a novel spring and a novel bolt stop plate that are part of the trigger.

2. Description of the Prior Art

Six centuries ago the crossbow gave harassed foot soldiers the deadly fire power they needed to effectively combat armour clad mounted knights. Today, sportsmen are enjoying the exciting sport of crossbow shooting on target ranges and on hunting and fishing expeditions. These sportsmen demand handsome crossbows that combine accuracy, durability, and safety at a reasonable price. Some early examples of modern crossbow art are disclosed by U.S. Pat. to Coates, No. 537,817, Bruder, No. 577,641; more recent examples are U.S. Pat. to Drake, No. 3,028,851, and Jones, No. 3,581,729.

A crossbow, which may have a seventy-five pound draw, is a dangerous weapon whose trigger mechanism should protect the operator and others from an accidental misfiring. The trigger mechanism must also be very reliable and durable if the crossbow is to be used outdoors for hunting or fishing. An accurate, adjustable rear sight on the trigger mechanism of a crossbow increases its usefulness as a sportsman's weapon. Providing all these desirable features in a crossbow trigger that can be sold at reasonable cost poses difficult problems for an inventor of crossbow mechanisms.

While arrows for use in conventional hand release bows may have a notch or nock in the rear end to accommodate the bowstring, one type of crossbow uses arrows or "bolts" that do not have a nock in the rear end. Proper firing of these crossbow bolts requires that when the crossbow string is drawn and the crossbow trigger cocked, a preselected space should be provided between the crossbow string and the rear end of the crossbow bolt clamped to the stock. When the trigger mechanism releases the string, it travels across this space before smacking into the bolt's rear end to launch it from the crossbow. Accordingly, another problem confronting the designer of crossbow mechanisms is how to provide this preselected space in a manner that will assure a uniform space from shot to shot yet not require careful adjustment for each shot.

One type of trigger is designed to slide tightly into a receiving slot in a crossbow stock. In such a trigger the moving interior parts may be pivotably mounted within a trigger housing on hinge pins that slide axially into holes in the housing sides for a flush fit. But it has been observed that should a slight axial movement of the hinge pins somehow occur, the pins may dislocate from their holes in the housing, making the trigger inoperative. Therefore, a better way to retain flush mounted pins must be found.

SUMMARY OF THE INVENTION

The present invention provides novel improvements for crossbow triggers that simplify construction and reduce assembly cost. A unitary leaf-type spring performs the four separate functions of clamping a crossbow bolt in a predetermined position on a crossbow stock, biasing a movable crossbow sight, biasing a crossbow trigger's finger lever, and preventing accidental disengagement of a crossbow trigger. A bolt stop plate provides proper spacing between a crossbow bolt's end and the portion of a drawn crossbow string intended to strike the bolt upon release. Inwardly recessed regions about each hinge pin hole in the trigger housing retain the trigger's hinge pins against accidental disengagement.

OBJECTS OF THE INVENTION

An object of the present invention is to produce a crossbow trigger having a reduced number of parts and simplified construction by providing a single spring that performs four functions.

Another object of this invention is to provide a novel sear configuration that automatically assures the proper spacing between the end of a crossbow bolt and a drawn crossbow string.

Another feature of this invention is the provision of hinge pin receiving regions about the trigger housing's hinge pin holes to prevent disengagement of hinge pins that experience slight axial movement.

Other objects, advantages, and novel features of the present invention will become apparent from the following detailed description of the invention when considered in conjunction with the accompanying drawings.

DESCRIPTION OF THE PREFERRED EMBODIMENT

Figures 1, 2:
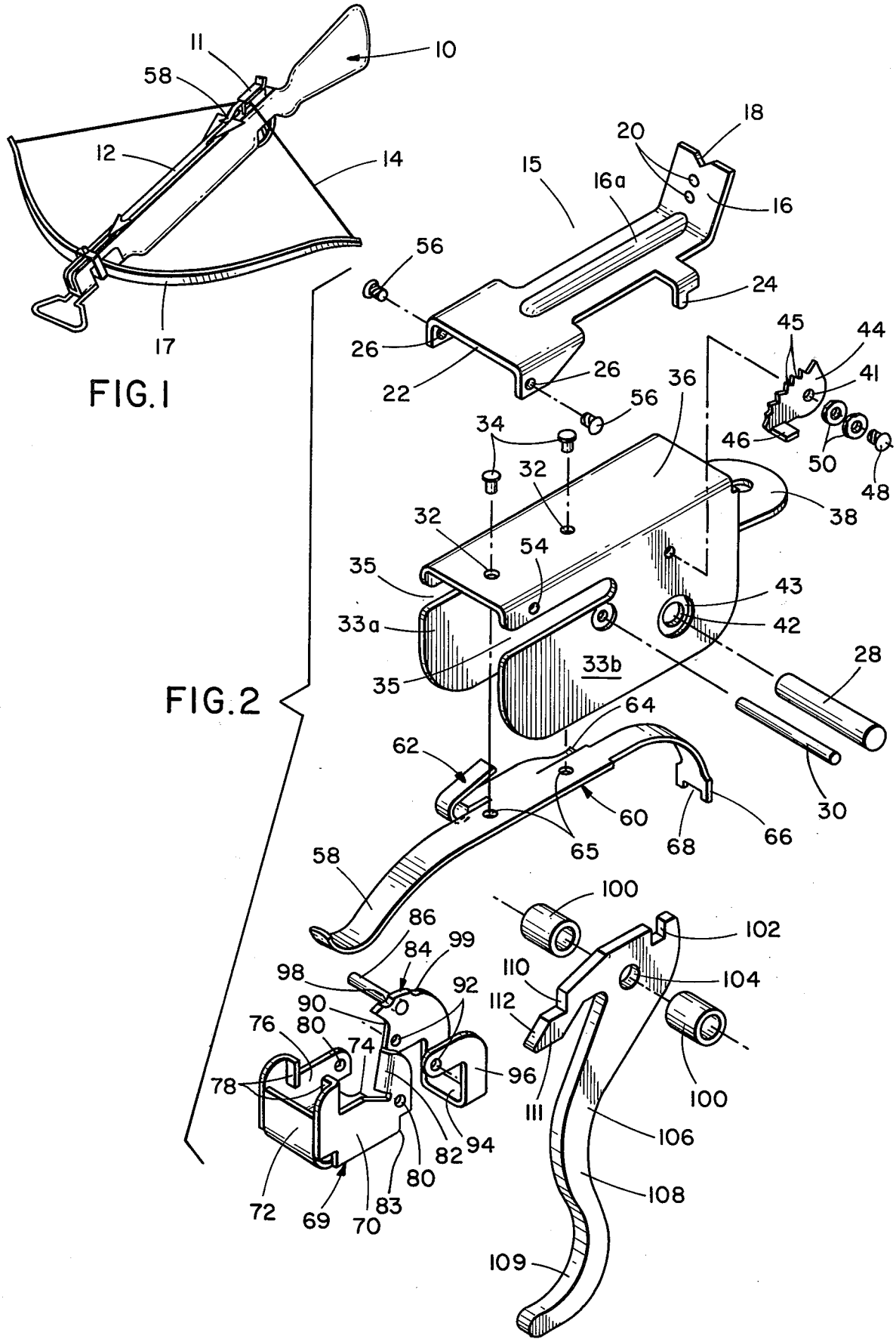
FIG. 1 is a perspective view illustrating a crossbow containing my trigger unit.
FIG. 2 is an exploded perspective view of a preferred embodiment of my invention.

In FIG. 1 my new and novel crossbow trigger unit 11 is mounted on a crossbow stock 10. A bowstring 14 of bow 17 is held in its drawn position. A bolt 12 is clamped to stock 10 in a ready-to-fire position.

Figure 9:
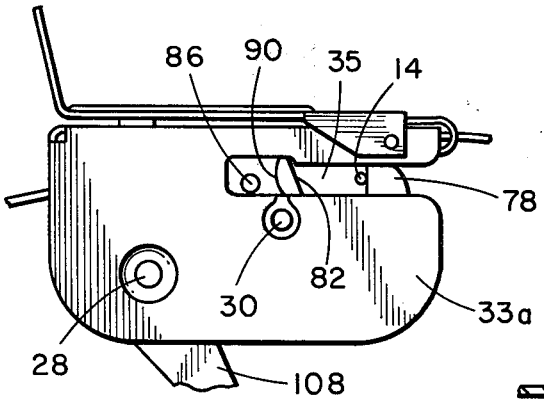
FIG. 9 is a right side view of the trigger unit in the region of the safety knob, the knob is in the safety position.

Referring to the preferred embodiment of FIG. 2 the basic parts of the trigger unit comprise a U shaped housing 31, a movable sight 15, a sear 69, a finger lever 106, a safety 84, and a unitary leaf-type spring 60. The sear 69, finger lever 106, safety 84 and spring 60 are critical parts that should be made of strong, durable material such as metal, more preferably a hard and tough metal e.g., heat treated metal. Housing 31 has a right side 33*a* and a left side 33 and a top 36. A mounting flange 38 can be used to secure housing 31 to a crossbow stock 10. Each housing side 33*a*, 33 has a bowstring slot 35 into which bowstring 14 is pulled to cock the trigger unit. At the end of the bowstring slot 35 on the right-hand side 33*a* is rectangular slot end 37 to provide an opening for movable safety knob 86, as is shown in FIG. 9.

Figure 3:
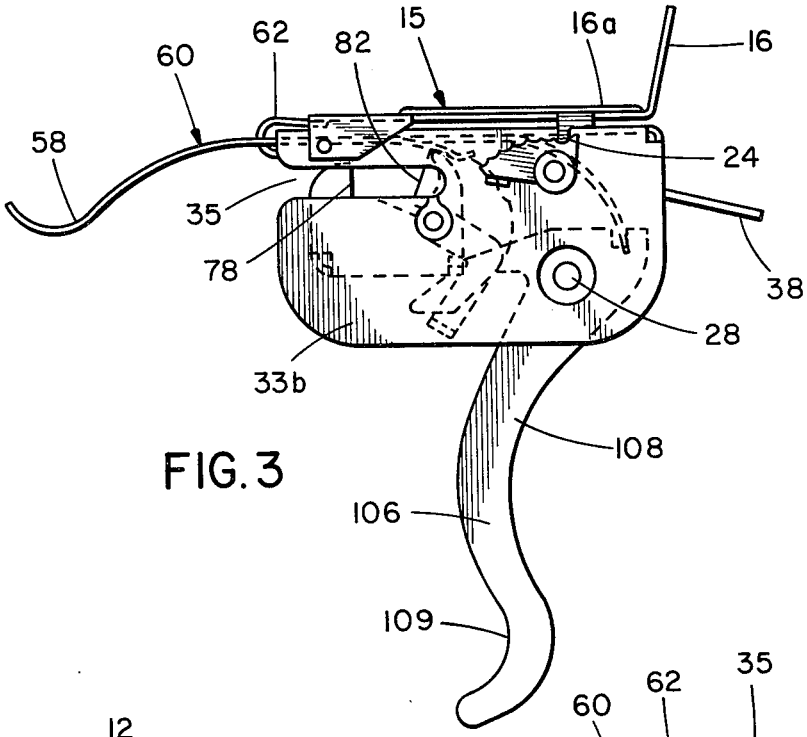
FIG. 3 is an exterior left side view of the embodiment of my trigger unit shown in FIG. 2 with the safety in the "safety" position.
Figure 4:
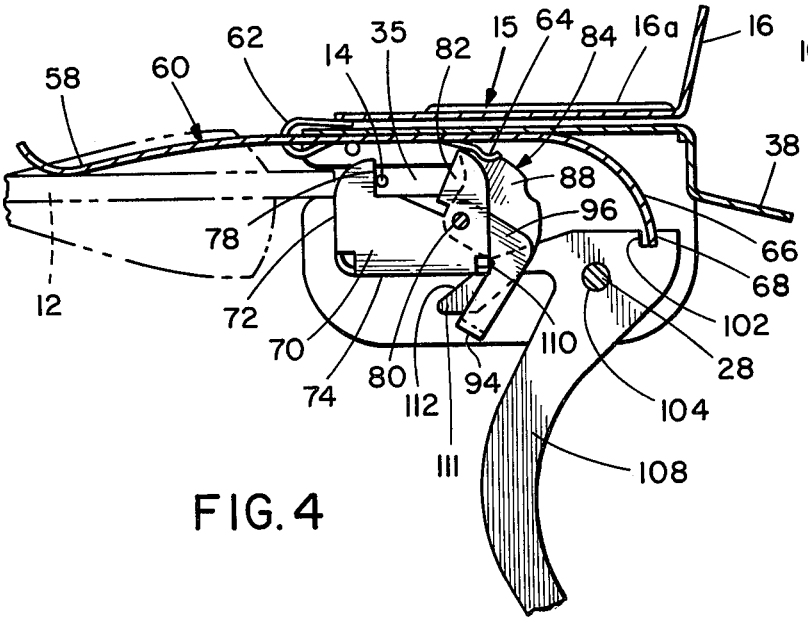
FIG. 4 is a cross sectional left side view of the embodiment of FIG. 2 with the safety in the safety position.
Figure 5:
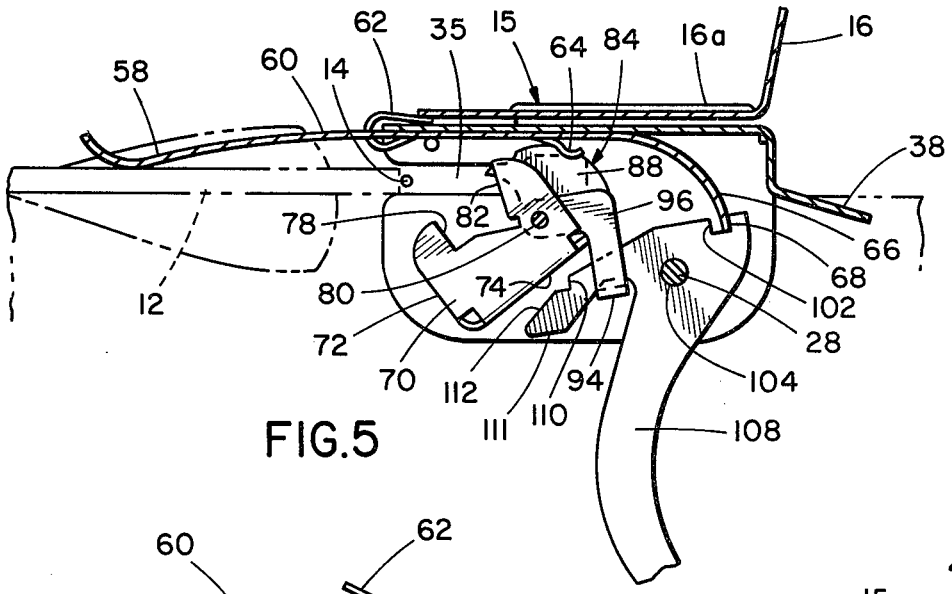
FIG. 5 is a cross sectional left side view similar to FIG. 4 except that the safety is in the "fire" position and the finger lever has just been drawn, releasing the sear and hence the bowstring held by the sear.
Figure 6:
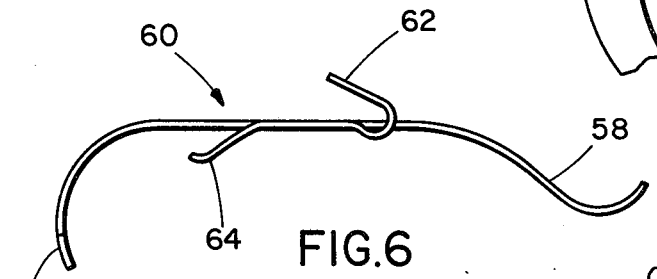
FIG. 6 is a right side view of the trigger unit's spring.
Figure 7:
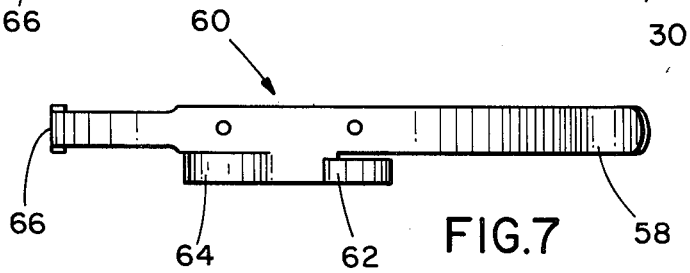
FIG. 7 is a top view of the trigger unit's spring.
Figure 8:
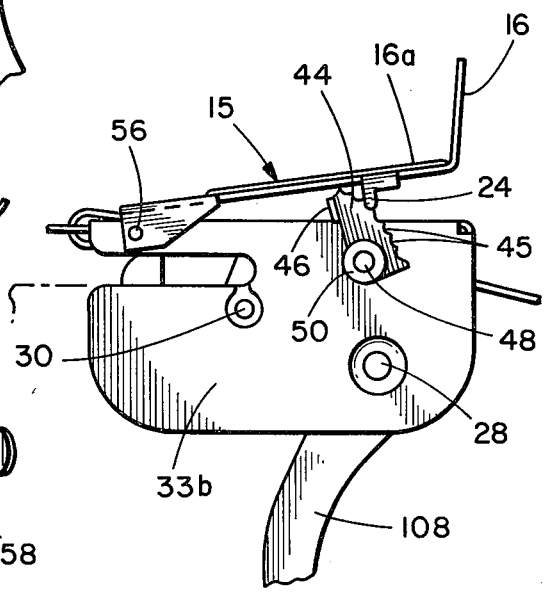
FIG. 8 is a left side view of the trigger's unit's sight, the sight being supported at an angle with respect to the housing by the trigger unit's elevator.

Unitary spring 60 is mounted to the underside of housing top 36 by any suitable fastening means, such as rivets 34. Each housing side 33*a*, 33 has a sear pin support hole 52 and a trigger hinge pin support hole 42. Sight 15 is pivotally mounted on the housing by screws 56 passing through mounting holes 26 into threaded holes 54. Sight 15 has a tail 16 in which there are view holes 20 and view notch 18. A sight elevator 44 having serrations 45 is movably mounted on the housing 31 by drive screw 48 passing through tension type washers 50, mounting hole 41, and screw hole 40. A dog leg 24 on the sight 15 engages serrations 45, as shown in FIG. 3 so that the view holes 20 can be raised and lowered with respect to the housing 31 as desired. Sight tail 16, including dog leg 24, is downwardly biased by the upward spring action of spring finger portion 62 which, as can be seen in FIGS. 4 and 5, is bent back upon itself over the housing 31 and under the sight's front edge 22. Since sight 15 pivots about drive screws 56, this upward bias of finger portion 62 on edge 22 biases dog leg 24 against serrations 45 of elevator 44.

Sear 69, safety 84, and finger lever 106 are pivotally mounted in the housing 31 on hinge pins 30 and 28 respectively, pins 30 and 28 being supported by holes 52 and 42 respectively in the housing 31. Sear hinge pin 30 passes through support holes 52 in housing 31, sear holes 80, and safety holes 92; thus sear 69 and safety 84 are commonly pivoted on pin 30, the safety within the sear, each being capable of separate rotation.

Figure 12:
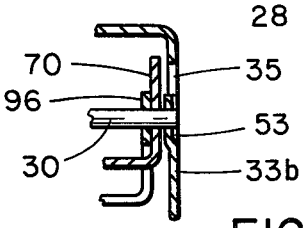
FIG. 12 is a section of FIG. 5 taken along A—A.

Trigger hinge pin 28 passes through support holes 42 in housing 31, through cylindrical spaces 100, and through hole 104 in finger lever 106. To prevent dislocation of either pin 28 or 30 by a slight axial movement, each housing side 33, 33*a* can be indented or countersunk in a region near each pin hole 42 or 52 as shown by regions 43 and 53 of FIG. 2 or region 53 of FIG. 12.

FIG. 2 indicates that unitary spring 60 fits under top 36 of housing 31 and terminates in four distinct spring finger portions: (1) first finger portion 58, (2) second finger portion 62, (3) third finger portion 66, and (4) fourth finger portion 64. It has already been noted that spring portion 58 is adapted to clamp a bolt 12 in a ready-to-fire position on a stock 10 as shown in FIGS. 1 and 4, and that spring portion 62 is adapted to provide an upward bias on front edge 22 of sight 15. Spring portion 66 terminates in a notch 68 designed to engage notch 102 in finger lever 106, as shown in FIGS. 3 – 5, so that spring portion 66 can supply a downward bias to pivoted finger lever 106 at notch 102.

Figure 10:
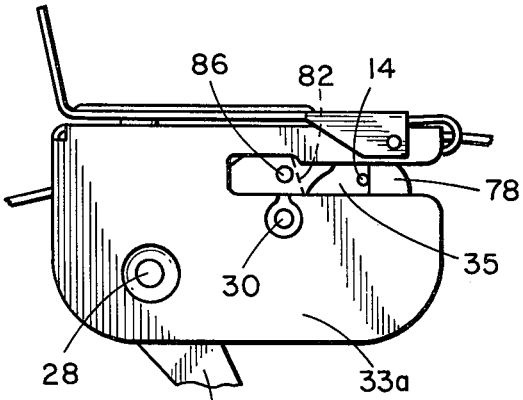
FIG. 10 is the same as FIG. 9 except that the safety knob is in the fire position.

As can be seen in FIG. 2, safety 84 is formed from a first L-shaped lateral plate 88, a second L-shaped lateral plate 96, and a bottom plate 94. Locking notches 98 and 99 are formed in the top edge 97 of lateral plate 88. The spring portion 64 is adapted to engage notches 98 and 99, one at a time, to retain safety 84 securely in either its safety position, as shown in FIGS. 4 and 9, or its fire position, as shown in FIGS. 5 and 10.

Sear 69 comprises a bottom plate 74, an L-shaped lateral plate 76, a C-shaped lateral plate 70, and a bolt stop plate 72 integral with the bottom plate. The L-shaped plate 76 and the C-shaped plate 70 are mutually parallel, and each has an integrally formed bowstring ear 78. Plate 72 extends perpendicularly upward between the lateral plates 70 and 76 only as far as the bowstring ears' bottom edge 79.

Figure 11:
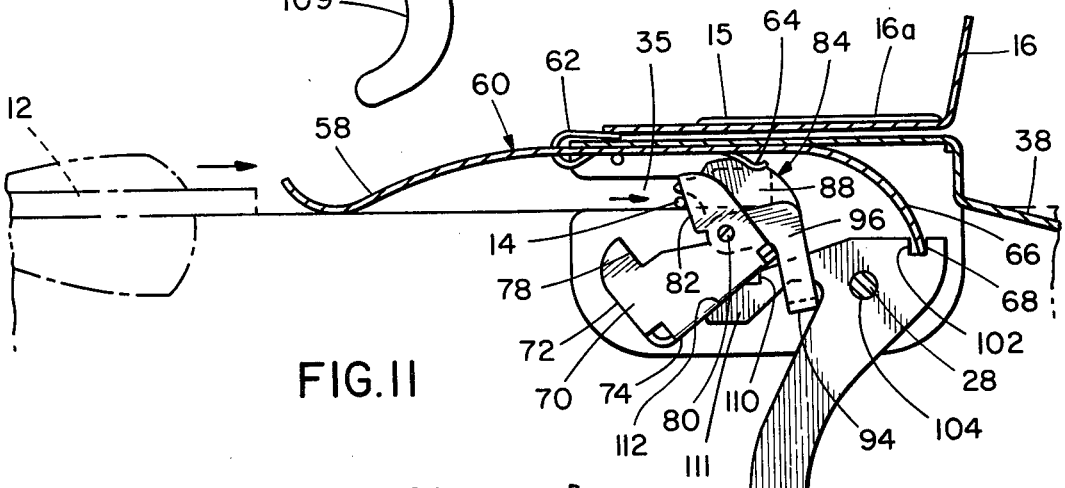
FIG. 11 is a left side view showing the trigger unit ready to be cocked.

In operation, the trigger unit is ready for cocking when it is in the position shown in FIG. 11. Sear 69 is positioned so that bowstring ears 78 lie beneath bowstring slots 35, leaving slots 35 free to accept a bowstring. When the crossbow operator draws a bowstring 14 into bowstring slots 35, bowstring 14 engages a cocking flange 82, pushing on flange 82 and causing sear 69 to rotate to a position where bowstring ears 78 block the bowstring slots 35. The same bowstring drawing motion also causes bowstring 14 to engage safety notch 90, the bowstring 14 pressure overcoming the locking bias of fourth finger portion 64 in locking notch 98 of safety 84. Safety 84 is caused to rotate into its safety position, as shown in Figure 3, where spring 64 then engages locking notch 99. Thus, by drawing the bowstring 14 into bowstring slots 35, the operator simultaneously moves sear 69 to its cocked position and moves safety 84 to its safety position where finger 64 engages notch 99 of the safety 84.

In FIG. 4 a bolt 12 has been pushed under finger portion 58 until the bolt's rear end 13 engages the sear plate 72. Bowstring 14 strains forward against bowstring ears 78, each of which has a restraining surface 77 perpendicular to both the lateral plate 70 or 76 from which it is integrally formed and the sear's bottom plate 74. Plate 72 automatically provides a space 75 between the restrained bowstring 14 and bolt end 13. Since the size of space 75 is determined by the fixed relationship between bolt stop plate 72 and bowstring ears 78, space 75 will be uniform from shot to shot. This automatic provision of a uniform space 75 for each shot is an important feature of my invention because it helps the operator obtain maximum shooting efficiency with each shot.

FIG. 4 also shows how the various portions within housing 31 are related when my trigger unit is in its cocked position and safety 84 is in its safety position as shown in FIG. 3. Because spring 66 downwardly biases finger lever 106 at spring notch 102, rotatable lever 108 is biased with a clockwise torque (as viewed in FIG. 4). Clockwise motion of finger lever 106 is prevented by the sear corner 83, which engages a right angle notch 110 in the finger lever 106. This same engagement of corner 83 and notch 110 prevents the sear 69 from rotating counterclockwise to release drawn bowstring 14, which is pushing against bowstring ears 78.

If the operator accidently pushes finger lever 106 while my trigger unit is in the safety position shown in FIGS. 3 and 4, safety bottom plate 94 obstructs counterclockwise rotation of finger lever 106, since such rotation would cause flat 111 of finger lever 106 to strike safety bottom plate 94. Thus accidental firing of the trigger unit by unintentional pressure on finger lever 106 is prevented when knob 86 of safety 84 is in its safety position.

When the operator is ready to fire the cocked crossbow trigger, he reaches for safety knob 86 shown in FIG. 9, pushing it forward against the retaining force of spring 64 in notch 99 so that the safety 84 is in the fire position as shown in FIG. 10. In FIG. 5 the operator has pushed rearwardly on finger notch 109; since counterclockwise rotation of finger lever 106 is no longer obstructed by safety bottom plate 94, the finger lever 106 can be pushed counterclockwise against the bias of spring 66 so that sear corner 83 no longer engages notch 110. The disengagement of corner 83 and notch 110 allows the sear 69 to rotate counterclockwise in response to pressure of bowstring 14 on ears 78. Ears 78 are rotated to a position below slots 35, releasing bowstring 14 to strike against the bolt end 13. It has been found significant that the pivoted mounting and geometry of sear 69 allows the portion restraining the bowstring, ears 78, to drop substantially directly downward, greatly reducing the amount of roll release of sear 69 can produce on the bowstring 14, thus eliminating excessive bowstring wear. In FIG. 5 bolt 12 and bowstring 14 are in motion, but the finger lever 106 is still shown in the position it would be pulled to by an operator. Spring 66 is providing the clockwise bias for lever 106 against which the operator pulls; when the operator releases his pull on lever 106, the bias provided by spring 66 automatically resets finger lever 106 to its unpulled position.

Although the invention has been described and illustrated in detail with reference to a particular embodiment, it is understood that the reference to this embodiment is for illustration and example only and is not to be taken as a limitation of the invention; the spirit and scope of this invention are limited only by the terms of the appended claims.

I claim:

1. In a trigger unit for a crossbow having a biasable bowstring, the trigger unit being capable of being secured to a crossbow stock and having:

a. a U-shaped housing with a top, left and right sides, interior and exterior protions, and forward and rear sections;

b. sight means movably attached to the forward section's exterior portion;

and each of the following pivotably mounted in the housing interior:

c. sear means for releasably holding a bowstring;

d. finger lever means in the rear section of the housing for releasably locking the sear means;

e. safety means for limiting the rotational movement of the finger lever means, the safety means having a safety position notch;

the improvement comprising only one unitary, leaf-type spring, and no coiled springs, for performing the functions in (1), (2), (3), (4), and (5) below and having:

1. a center portion atached to the top of the trigger housing;
2. a first finger portion means extending forward beyond the housing's forward section for clamping a crossbow bolt in a predetermined position on the stock;
3. a second finger portion means extending forward beyond the housing's forward section and folding back upon itself across the forward section's exterior portion for continuously biasing the movable sight means;
4. a third finger portion means extending rearward for continuously biasing the finger lever means; and
5. a fourth finger portion means extending rearwardly of the housing for engaging the safety means' safety position notch, whereby accidental disengagement of the safety means is prevented.

2. The invention of claim 1 including a further improvement wherein the sear means, finger lever means, safety means, and spring are formed of metal.

3. The invention of claim 1 including a further improvement wherein the sear means and the safety means are pivotally mounted in the housing interior on a common sear hinge pin with the safety means within the sear means.

4. The invention of claim 3 including a further improvement wherein the finger lever means is pivotally mounted in the housing interior on a trigger hinge pin whose ends pass through trigger pin holes in the housing's left and right sides, each housing side being indented or countersunk towards the housing's interior portion in a region near each pin hole, whereby a hinge pin no longer than the average side to side distance of the housing will not be dislocated from its pin hole by a slight axial movement of the pin.

5. The invention of claim 1 including a further improvement wherein the sear means includes bolt stop plate means for automatically providing a uniform preselected space between the end of a crossbow bolt and a portion of the bowstring, in its biased position, intended to strike the bolt's end when the bowstring is released.

6. In a trigger unit for a crossbow having a biasable bowstring, the trigger unit being capable of being secured to a crossbow stock and having;

a. a U-shaped housing with a top, left and right sides, interior and exterior portions, and forward and rear sections;

b. sight means movably attached to the forward section's exterior;

and each of the following pivotably mounted in the housing interior:

c. sear means for holding a bowstring;

d. finger means lever in the rear section for controlling the sear means' movement;

e. safety means for preselectively restraining the firing lever's movement, the safety means having a position notch;

the improvement comprising:

flat bolt stop plate means, on the sear means, for automatically providing a uniform preselected space between the end of a crossbow bolt and a portion of the bowstring, in its biased position, intended to strike the bolt's end when the bowstring is released.

7. The invention of claim 6 including a further improvement wherein the sear means further comprises:

1. a bottom plate;
2. an L-shaped lateral plate and a C-shaped lateral plate, the two lateral plates being mutually parallel and each having a bowstring ear integral with its upper front portion; and
3. a cocking flange integrally formed from the upper rear portion of the second C-shaped lateral plate;

and the bolt stop plate means is integral with the bottom plate and extends perpendicularly upward from the bottom plate between the two lateral plates only a high as the bowstring ears' bottom edge.

8. The invention of claim 7 including a further improvement wherein each bowstring ear has a bowstring restraining surface perpendicular to both the lateral plate from which the ear is integrally formed and the sear means' bottom plate.

9. The invention of claim 8 including a further improvement wherein the sear means is pivotally mounted in the housing interior by a sear hinge pin passing through a first sear pin hole in one side of the housing, through a first sear hinge hole in one of the lateral plates, through a second sear hinge hole in the other lateral plate, and through a second sear pin hole in the other housing side.

10. The invention of claim 9 including a further improvement wherein the sear means is pivotally mounted in the housing interior to allow the bowstring ears to drop substantially directly downward when the sear means is released by motion of the finger lever, whereby the amount of bowstring roll produced by the sear means' dropping to release the drawn bowstring is greatly restricted.

* * * * *